United States Patent [19]

Gray, III et al.

[11] 4,435,461

[45] Mar. 6, 1984

[54] METHOD OF PROVIDING A SURFACE EFFECT IN A RELEASE PAPER PRODUCT

[75] Inventors: Lorin S. Gray, III, Portland; Jeffrey S. Doody, Yarmouth, both of Me.

[73] Assignee: Scott Paper Company, Philadelphia, Pa.

[21] Appl. No.: 435,209

[22] Filed: Oct. 19, 1982

[51] Int. Cl.[3] ..... B05D 3/06

[52] U.S. Cl. ..... 428/141; 428/425.1; 428/481; 428/511; 428/172; 427/44; 427/362; 427/156

[58] Field of Search ..... 427/44, 362, 156; 428/413, 425.1, 481, 511, 537, 141, 172

[56] References Cited

U.S. PATENT DOCUMENTS

| | | | |
|---|---|---|---|
| 4,070,497 | 1/1978 | Wismer et al. | 427/44 |
| 4,113,894 | 9/1978 | Koch | 427/44 |
| 4,219,596 | 8/1980 | Takemoto et al. | 427/44 X |
| 4,238,526 | 12/1980 | Chitouras | 427/44 |
| 4,289,821 | 9/1981 | Gray et al. | 427/44 X |
| 4,322,450 | 3/1982 | Gray et al. | 427/44 |

*Primary Examiner*—George F. Lesmes
*Assistant Examiner*—Nancy A. B. Swisher
*Attorney, Agent, or Firm*—R. Duke Vickrey; John W. Kane; Francis M. DiBiase

[57] ABSTRACT

Disclosed is an improved method of providing a desired surface effect in a release coating including the steps of applying a coating of an electron beam radiation curable composition or material to a side of a substrate, pressing the coated side of the substrate against a replicative surface having the desired surface effect, and irradiating the coating with electron beam radiation through the substrate to partially cure the coating sufficiently to enable it to be removed with the substrate from the replicative surface securely attached to the substrate and with the replicated surface effect in the coating being maintained, the improvement being the further step of irradiating the coating a second time, preferably from the other side, with electron beam radiation without first applying additional coating. Also disclosed is the resulting product.

10 Claims, 1 Drawing Figure

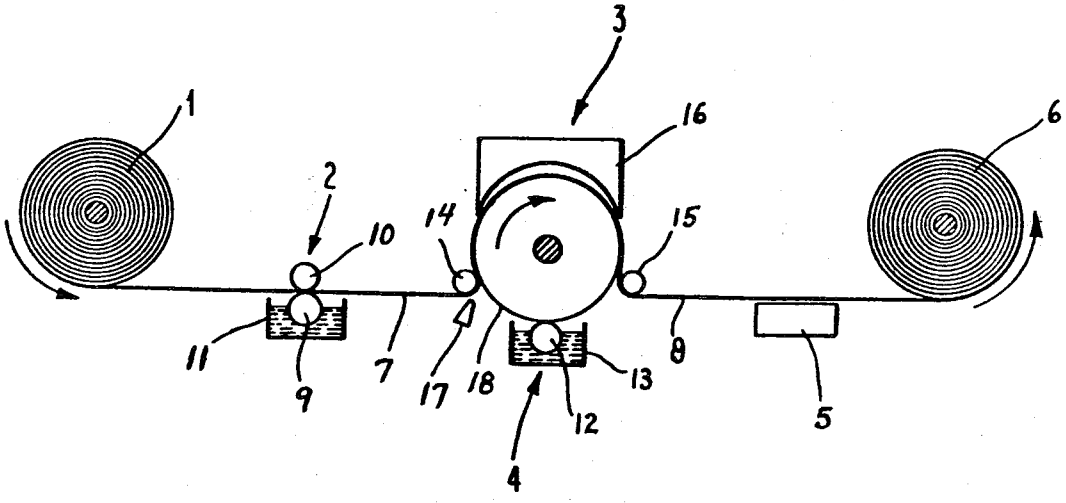
1
2
3
4
5
6
7
8
9
10
11
12
13
14
15
16
17
18

METHOD OF PROVIDING A SURFACE EFFECT IN A RELEASE PAPER PRODUCT

TECHNICAL FIELD

The present invention relates to coatings for paper and other substrates, and particularly to release coatings which are characterized by their ability to separate intact from a surface which is normally adherent. More specifically, the invention relates to an improved method for providing a desired surface effect in the release coating and to the superior release properties of the release sheet product so produced.

BACKGROUND ART

A number of processes exist in which a plastic film or sheet is formed on or against a release sheet and then separated from the release sheet after taking steps, such as cooling or curing, to set the film or sheet. Curing, where necessary, may be accomplished by heat, by peroxide catalyst, or by U.V. radiation or by electron beam radiation. The release sheet provides a surface from which the set plastic material can be readily separated and imparts to the surface of the plastic material the quality of finish of the release surface. For example, a desired textured surface can be provided on the surface of the plastic material by forming on or against a release sheet having the mirror image of the desired textured surface.

One example of such forming processes is "casting", wherein a resinous material, such as polyvinyl chloride or polyurethane resin, in a flowable state is deposited or "cast" onto the release sheet surface, heated, cured and cooled to consolidate the resinous material into a continuous self-supporting film, and stripped from the support. The release sheet is normally provided with a desired surface effect, such as high gloss, texturing or an embossed configuration, and the surface effect is replicated on the cast film.

Another example of such forming processes is "panel pressing" of decorative plastic laminates, which can be either of the high pressure or low pressure type. In high pressure panel pressing, decorative laminates are conventionally prepared by assembling in a stacked relationship a plurality of core sheets, each of which is a web of paper impregnated with a resinous material, such as phenolic resin. Immediately positioned above the core sheet assembly is a decorative sheet, which is a resin saturated sheet having a solid color or a suitable design thereon. Superimposed above the decorative sheet is generally an overlay sheet which is a thin sheet of fine paper impregnated with a noble thermosetting resin, such as a melamine formaldehyde resin or an unsaturated polyester resin and the like (and is generally the same resin used to impregnate the decorative sheet). The entire assembly of core sheets, decorative sheet, and overlay sheet is placed between platens in a press and consolidated by application of heat and pressure. Generally, a release sheet having the desired surface effect to be reproduced in the surface of the overlay sheet is placed against the overlay sheet during pressing. High pressure laminates after being consolidated are usually further glued to a structural substrate, such as particle board or plywood. Low pressure panel pressed decorative laminates are made in a similar manner to high pressure laminates, but generally involve lamination of the decorative sheet directly to particle board or other structural substrate.

Other pressing processes where a plastic film or sheet is formed on or against a release sheet may not include the lamination step, but only texturing a moldable plastic surface which is already laminated. For example, a plastic film could be coated directly onto particle board or plywood and then textured by pressing against a release sheet having the desired textured pattern in its surface. (See, for example, U.S. Pat. No. 4,113,894 to Koch.)

Other uses for release sheets include heat transferable printed designs and pressure sensitive adhesive coated webs. The heat transferable printed designs are printed on the release sheet with a polyvinyl chloride plastisol ink or offset printing ink and overcoated with a polyvinyl chloride plastisol. When placed against a receptive surface, such as a T-shirt, and heated, the printed design and overlayer are transferred to the receptive surface. On the other hand, pressure sensitive coated webs are typically adhesive coated tapes, labels or decals and the like which are attached to a release surface for easy removal when it is desired to permanently attach them. The release surface must permit temporary attachment of the pressure sensitive adhesive, but also permit easy removal.

Other uses of release sheets similar to the panel pressing area include use as an interleaver between groups of laminae pressed at the same time in back to back configuration to form two distinct decorative laminates. The release sheet in this case separates the laminates from each other and thereby permits more than one to be pressed at the same time between the same platens. (See, for example, U.S. Pat. No. 4,030,955 to Antonio et al.)

Release sheets are typically made by coating, treating, or impregnating a paper sheet or other substrate with a release coating of such materials as polymethylpentene, polypropylene, polyfluorocarbons, silicone oil, thermoset silicone resins, and other conventional release agents. Surface effects on the release sheet are conventionally provided by any one of a number of techniques. The release coating can be dried to a smooth surface gloss, or surface effects such as texturing or embossing can be provided in the coating by mechanical means, applied either to the surface of the paper before coating or to the paper after the coating is applied. Another technique employed for producing a release coating with a textured surface is to extrude a molten thermoplastic film such as polypropylene or polymethypentene, onto a paper surface, cool it and then pass it between matched steel embossing rolls. In all cases a satisfactory release paper must have its release coating securely adhered to the substrate so that it will remain with the substrate when the sheet or film formed on or against it is stripped.

One disadvantage of these typical prior art techniques is that the pattern of the embossing rolls or other mechanical means is not completely replicated in the surface of the release coating. That is, the entire embossure depth of the embossing rolls or other mechanical means is not reproduced in the release coating, often providing only about 60% actual replication. This shortcoming is particularly acute in producing fine patterns such as wood grain or leather grain, where the finer parts of the pattern can be lost in the replication process.

The disadvantages associated with the prior art techniques of providing only about 60% actual replication was virtually eliminated with the inventions of U.S. Pat. No. 4,289,821 and U.S. Pat. No. 4,322,450 (both of which are hereby incorporated by reference herein). These patents disclose coating a substrate with an electron beam curable release coating and then irradiating the coating while it is in contact with a replicative surface having the desired surface effect. The irradiation takes place through the substrate since the coating must be kept against the replicative surface. This method can produce a release coating which simulates the replicative surface almost 100%. Curing the coating against a surface, however, results in poorer release properties than one cured by irradiating the coating out of contact with the replicative surface. An alternate method disclosed in the patents which improves the release properties includes the additional steps of applying a second coating of electron beam curable material over the first layer already at least partially cured and then curing the second layer. This alternate method improves the release properties by curing a fresh coating layer out of contact with a replicating surface, but it reduces reproduction fidelity significantly.

DISCLOSURE OF THE INVENTION

The present invention is an improvement in a method of providing a desired surface effect in a release coating on a substrate which method comprises the steps of:

A. applying a coating of an electron beam radiation curable composition or material to a side of a substrate;

B. pressing the coated side of the substrate against a replicative surface having a desired surface effect to cause the surface of the coating to conform to the replicative surface;

C. irradiating the coating with electron beam radiation directed first through the substrate to partially cure the coating sufficiently to enable it to be removed from the replicative surface securely attached to the substrate and with the replicated surface effect in the coating being maintained; and D. stripping the substrate from the replicative surface with the partially cured coating adhered to the substrate.

The improvement is the further step of,

E. irradiating the coating a second time with electron beam radiation without first applying additional coating composition or material over the first coating.

Step E preferably includes the second curing step taking place while the coating is out of contact with any surface and more preferably with the second radiation curing step being applied directly to the coating from the other side of the substrate.

The invention provides all the advantages of the method taught in U.S. Pat. Nos. 4,289,821 and 4,322,450 and also greatly improved release properties. Although the embodiment of the above-identified patents in which a second coating is applied and cured away from the replication drum will provide the superior release properties, it loses a significant amount of the replication fidelity. The present invention does not have this loss.

The replicative surface is preferably provided by a roll, drum, or other cylindrical surface, which can be revolved past an electron beam curing device. The coating is preferably applied directly to the substrate, which is preferably paper, but can also be applied to the roll before the substrate engages the roll. The replicative surface is preferably a metal roll with a texture or embossure engraved in its surface, but it can also have other surface effects, such as a highly polished surface. One of the most important advantages of the invention is that the texture, embossure or other finish of the replicative surface is essentially one hundred percent reproduced in the cured coating, as is the case in the methods of U.S. Pat. Nos. 4,289,821 and 4,322,450, but in the present invention with vastly improved release properties. This enables replication of very fine patterns in the release paper such as wood grain and leather grain. The criticality of using electron beam radiation is that it can penetrate opaque substrates such as paper and deeply into thick coatings. Other forms of radiation curing such as U.V. radiation can only penetrate optically clear substrates and not into thick coatings.

The second application of electron beam radiation can be applied by a separate electron beam unit or it can be provided by the same unit as the first by rewinding the partially cured coated substrate and transporting it a second time through the first unit, preferably with the coated side facing the electron beam unit. Another alternative would be to festoon the substrate as it leaves the replication drum to have it return between the electron beam unit and the drum while continuing to radiate the first pass portion of the coated substrate.

In the preferred form of the invention the coating penetrates a paper substrate and adheres sufficiently to permit the coated substrate to perform as a release paper. That is, the electron beam cured coating will remain securely attached to the substrate when a sheet or film formed on or against the release coating is stripped from it. In order to perform satisfactorily as a release coating the coating must be in continuous intimate contact with the coated paper. No spaces or voids between the coating and paper can be permitted. This advantage can be provided by coating the electron beam curable composition directly to the substrate, the substrate having the proper porosity, and permitting sufficient time between coating and curing to permit the coating to penetrate the substrate, all as described in U.S. Pat. No. 4,322,450.

The substrate is preferably provided by coated paper which has an air porosity of at least 0.08 cc./min./cm$^2$ under an air pressure of 10 kPa (1.5 p.s.i.). The amount of time preferred between coating and curing is at least one second. The coating viscosity affects the penetration to some extent, but within the preferred range of less than 1300 centipoise is not critical.

The invention is also the release sheet produced by the method of the invention, which comprises a substrate having on at least one side thereof a coating of an electron beam radiation curable composition or material which has been cured by electron beam radiation applied in a first application while the coating, is against a surface and in a second application while the coating is not against a surface. Preferably the second application is applied directly against the coating from the side of the substrate opposite the direction of the first application. The release sheet is distinctive in its degree of surface effect replication and its release properties, as a result of having been partially electron beam cured through the substrate while the coating was in contact with a replication surface, and having a second cure applied by electron beam radiation while the coating is out of contact with the replication surface.

BRIEF DESCRIPTION OF THE DRAWING

The drawing illustrates schematically the preferred apparatus for carrying out the present invention. The drawing shows a base paper substrate roll being coated with an electron beam curable composition either directly or by way of coating a replication roll and pressing the paper against it, after which the paper, coating and roll are revolved together past an electron beam curing station where the coating is partially cured, and the paper, with the partially cured coating adhered to it, is stripped from the roll and then the coated surface is directly irradiated with electron beam radiation in the absence of applying any further coating.

BEST MODE FOR CARRYING OUT THE INVENTION

Referring to the drawing, a roll 1 of base paper is unwound and passed through the following: a coating station 2; an electron beam curing station 3, which can include optional coating station 4; and second curing station 5, from where it is wound into roll 6. The coating station 2 is provided by coating roll 9 and backup roll 10 positioned to form a nip through which the paper 7 passes. Coating roll 9 rotates through reservoir 11 of the coating material and transfers a predetermined layer of coating material to one side of paper 7.

Optional coating station 4 is provided by coating roll 12 mounted for rotation in reservoir 13 of coating material and against engraved roll 18. The coating roll 12 transfers a predetermined layer of coating material to the engraved roll 18. The coating station 4 would be used when coating station 2 is not or when it is desirable to apply coating material at both stations, for example when a heavier coating is desired or when different coating compositions in a layered arrangement are desired. The above-described coating apparatus is preferred for coating station 2 or coating station 4, but any of the conventional coating apparatus, such as knife-over-roll, offset gravure, reverse roll, etc., can be used.

The replicative surface is provided by roll 18, in which the desired texture is engraved in the surface. The paper 7 is pressed against the roll 18 by press roll 14 to assure that the coating fills the depressions in the textured surface of the roll 18 and that there is continuous intimate contact with the paper. The roll 18 is mounted for rotation by conventional drive means (not shown) and continuously carries the paper and coating past the electron beam radiation unit 16 which irradiates the coating through the paper and partially cures it sufficiently to permit it to be removed from the roll 18 at take-off roll 15, securely attached to the paper 8, and to assure permanent replication of the desired surface. The irradiation step takes place preferably after sufficient time has passed for the coating to penetrate into the pores of the substrate, a process element which is further facilitated by coating directly to the substrate.

The amount of coating applied to the substrate and/or replicative surface can be varied somewhat, depending upon the surface effect and pattern depth on the replicative surface. The coating is spread by the pressure of the press roll 14 and fills the contours of the replicative surface while providing a continuous layer on the substrate. The amount of coating will typically range from about 22.2 grams to about 44.4 grams per square meter (15–30 lbs. per ream of 3300 square feet) for a contoured surface, but for a smooth replicative surface it could be as little as about 5 grams per square meter.

If the replication pattern contours are to be reproduced in the coating only and not also in the paper substrate, the coating must be sufficiently thick to permit this. If the pattern contours are to be reproduced in the paper also, less coating can be used and higher pressure and a harder press roll 14 would be used.

Electron beam radiation units useful in the present invention are readily available and typically consist of a transformer capable of stepping up line voltage and an electron accelerator. In one type of machine the electrons are generated from a point source filament and then scanned electromagnetically like a television set to traverse the coated object. In another type of machine, the electrons are generated in a curtain from an extended filament which can irradiate the entire width of the surface without the need for scanning. While commercial machines are available with accelerating voltages of over a million electron volts, the range for this and similar coating applications is typically from 150–300 KV (kiloelectron volts). It is common when curing coatings with electron beam radiation units to take steps to eliminate oxygen from the surface of the coating. In the present apparatus, a nitrogen atmosphere is applied through nozzle 17. The second curing is preferably done in a non-oxygen atmosphere. This can be accomplished by providing a nitrogen (or other inert gas) atmosphere between the paper and the curing unit 5 by such conventional means as a nozzle exhausting nitrogen against the partially cured coating as it enters the curing unit.

The coating applied to the paper must be capable of being cured by electron beam radiation. Typical resins useful in electron beam curable coatings are styrenated polyesters and acrylics, such as vinyl copolymers of various monomers and glycidyl methacrlylate reacted with acrylic acid, isocyanate prepolymers reacted with an hydroxyalkyl acrylate, epoxy resins reacted with acrylic or methacrylic acid, and hydroxyalkyl acrylate reacted with an anhydride and subsequently reacted with an epoxy. In some cases it may be desirable to include small amounts of conventional release agents, such as silicone oils.

Coating compositions which can be cured by electron beam radiation and are suitable for release functions generally include some or all of the following:

(a) an acrylate or methacrylate functional oligomer;
(b) a reactive monomer diluent (a mono or multifunctional acrylate or methacrylate) such as trimethylolpropane triacrylate or isodecyl acrylate;
(c) pigments or fillers such as clay, silica or diatomaceous earth;
(d) reactive or non-reactive silicones; and
(e) organic diluents such as acetone or carbon tetrachloride.

The following examples illustrate preferred coating formulas and preferred embodiments of the invention.

EXAMPLE 1

A coating composition was prepared from:

| | Parts by Wgt. |
|---|---|
| isodecyl acrylate | 23.5 |
| trimethylolpropane triacrylate | 41.9 |
| urethane oligomer (Purelast 186, Polymer Systems) | 34.6 |

Examples of the invention and of the prior art were produced on an apparatus similar to that illustrated in the drawing. The replicative surface was provided by a chrome plated steel roll having a diameter of approximately 21.6 cm. (8½ in.). The surface of the roll had a smooth high gloss finish.

The paper substrate used was of the type conventionally used for the base of casting grade release paper and had a conventional pigment/binder base coat to improve hold up of the release coating. The substrate was unwound from a roll on a unwind stand, passed through the apparatus of the invention and rewound onto a roll. The radiation curable coating was applied to the underside of the paper at a coater like the coater station 2 illustrated in the drawing and positioned about 2 meters from the electron beam unit. Paper and coating were pressed against the replicative roll by a rubber covered roll, making intimate contact between the paper substrate, the coating, and the replicative roll and conforming the coating to the surface of the replicative roll. The paper, coating and replicative roll were rotated past a first electron beam radiation unit at a line speed of about 20 meters per minute, the coating was cured with varying dosages and the paper and coating stripped from the roll in the manner illustrated in the drawing. The partially cured coating was then passed a second time under an electron beam curing station where it was subjected to further radiation of varying dosages directed against the coated side of the paper. The electron beam radiation units were operated at 200 KV.

To test the release characteristics of the prepared samples in this and the following example, thermoplastic polyester urethanes were cast onto them, dried at 100° C. in a non-circulating air oven for 1½ minutes and cured at 160° C. in an air circulating oven for 1½ minutes to form a 25.4 microns (1 mil) thick film. The film was then stripped from the release surface in an Osgood-Sutermeister release tester, which provides a comparative measurement of the energy required to strip a sample of the cured film 3.8 cm.×7.7 cm. from the release paper. Any release surface which permits stripping of the film with less energy than 47 Joules per square meter is considered satisfactory, and below 35 J./m$^2$ is preferable. Similarly, the samples were tested with films of polyvinyl chloride plastisols. The polyvinyl chloride plastisol films were dried at 100° C. in a non-circulating oven for 3 minutes and cured at 190° C. in an air circulating oven for 1½ minutes to form 101.6 microns (4 mil) thick films.

One grade of urethane and two grades of vinyl plastisol were used in the tests. For simplicity they are called Urethane #1, Vinyl #1 and Vinyl #2. The higher number indicates that the film is more difficult to strip from release surfaces.

TABLE I

| Dose (Megarads) 1st Electron Beam Station | | 2nd Electron Beam Station | Release Values J./m.$^2$ Urethane #1 | Vinyl #1 |
|---|---|---|---|---|
| 8 Mr | followed by | 0 Mr | 50.9 | 33.9 |
| 4 | " | 0 | 45.2 | 33.9 |
| 4 | " | 1 | 33.9 | 28.9 |
| 4 | " | 2 | 28.9 | 22.6 |
| 4 | " | 3 | 28.9 | 22.6 |
| 4 | " | 4 | 22.6 | 22.6 |

EXAMPLE 2

A coating composition was prepared from:

| | Parts by Wgt. |
|---|---|
| isodecyl acrylate | 32.9 |
| trimethylolpropane triacrylate | 36.9 |
| silicone modified urethane acrylate resin - (Chempol 19-4842 by Freeman Chemical Corporation) | 30.2 |

Using a substrate similar to that of the preceding examples, the above composition was coated onto the substrate using the apparatus of the preceding example at a speed of 20 meters per minute. The radiation doses were varied at the radiation stations. The coated samples were tested for release using urethane #1, and vinyl #2. The results are listed in Table II.

TABLE II

| Dose (Megarads) 1st Electron Beam Station | | 2nd Electron Beam Station | Release Values J./m.$^2$ Urethane #1 | Vinyl #2 |
|---|---|---|---|---|
| 2 | followed by | 0 | 50.9 | 66.2 |
| 2 | " | 2 | 11.3 | 11.3 |
| 2 | " | 6 | 11.3 | 11.3 |
| 4 | " | 0 | 45.2 | 22.6 |
| 4 | " | 2 | 17.0 | 11.3 |
| 4 | " | 6 | 17.0 | 11.3 |
| 6 | " | 0 | 56.5 | 22.6 |
| 6 | " | 2 | 22.6 | 17.0 |

Table I gives the release results of samples that were cured with 8 and 4 megarad doses at the first radiation station followed by zero to 4 megarad doses at the second radiation station. One can see that the best release results were obtained with cast urethane and vinyl films when a 4 megarad dose was followed by a 2–4 mr dose from the second unit. Table II give the release results of samples that were cured with 2, 4 and 6 megarad doses at the first radiation station followed by zero, 2 and 6 megarad doses at the second station. In all cases release is dramatically improved by some curing at a second station compared to curing at the first station only. It can be seen that the level of release properties obtained by the second cure cannot be obtained in a simple cure at the first station no matter how much dose is applied.

What is claimed is:

1. In a method of providing a desired surface effect in a release coating on a substrate, comprising the steps of:

A. applying a coating of an electron beam radiation curable composition or material to a side of a substrate;

B. pressing the coated side of the substrate against a replicative surface having a desired surface effect to cause the surface of the coating to conform to the replicative surface;

C. irradiating the coating with electron beam radiation directed first through the substrate to partially cure the coating sufficiently to enable it to be removed from the replicative surface securely attached to the substrate and with the replicated surface effect in the coating being maintained; and D. stripping the substrate from the replicative surface with the partially cured coating adhered to the substrate;

The improvement including the further step of

E. irradiating the partially cured coating out of contact with the replicative surface a second time with electron beam radiation without first applying additional coating composition or material over the first coating.

2. The method according to claim 1, wherein the second irradiation step is applied with the coating out of contact with any surface.

3. The method according to claim 1, wherein the second irradiation step is applied by directing the radiation directly against the coating from the side of the substrate opposite to the direction of the first irradiation application.

4. The method according to claim 1, wherein the substrate is provided by paper.

5. The method according to claim 1, wherein the desired surface effect in the replicative surface is a contoured surface.

6. The method according to claim 1, wherein the desired surface effect in the replicative surface is a smooth surface.

7. A release sheet produced by the method of claim 1.

8. A release sheet according to claim 7, comprising a substrate having on at least one side thereof a coating of an electron beam radiation curable composition or material which has been cured by electron beam radiation applied from both sides of the coating.

9. The release sheet according to claim 7, wherein the substrate is provided by paper and the coating penetrates the paper and is in continuous intimate contact.

10. The release sheet according to claim 9, wherein the paper had an air porosity of at least 0.08 cc/min./cm$^2$ under an air pressure of 10 kPa before coating with the electron beam radiation curable composition.

* * * * *